US006164237A

United States Patent [19]

Coryell et al.

[11] Patent Number: 6,164,237

[45] Date of Patent: Dec. 26, 2000

[54] INFLATABLE WATERCRAFT

[76] Inventors: Dale C. Coryell, 17902 - 69th Ave. West, Edmonds, Wash. 98026; David A. Inks, 5629 Skyview Dr., Florence, Mont. 59833; William H. Stutz, 5261 College View Ave., Eagle Rock, Calif. 90041

[21] Appl. No.: 09/233,644

[22] Filed: Jan. 19, 1999

Related U.S. Application Data

[60] Provisional application No. 60/085,028, May 11, 1998.

[51] Int. Cl.[7] ..... B63B 7/00

[52] U.S. Cl. ..... 114/345; 441/40

[58] Field of Search ..... 114/345, 266, 114/267; 441/130, 131, 132

[56] References Cited

U.S. PATENT DOCUMENTS

| | | | |
|---|---|---|---|
| 1,764,852 | 6/1930 | Phillips | 441/131 |
| 1,996,576 | 4/1935 | Hedgewaldt | 441/130 |
| 2,456,637 | 12/1948 | Kearny | 114/345 |
| 2,747,204 | 5/1956 | Erickson | 114/351 |
| 2,894,270 | 7/1959 | Manthos | 441/131 |
| 4,160,299 | 7/1979 | Hilbern | 441/131 |
| 4,919,067 | 4/1990 | Wenstob et al. | 114/345 |
| 5,090,930 | 2/1992 | Walden | 441/131 |
| 5,297,978 | 3/1994 | Ramsey | 441/131 |
| 5,474,481 | 12/1995 | Ramsey | 441/131 |

FOREIGN PATENT DOCUMENTS

| | | | |
|---|---|---|---|
| 27803 | 3/1907 | Austria | 441/131 |

*Primary Examiner*—Jesus D. Sotelo
*Attorney, Agent, or Firm*—Todd N. Hathaway

[57] ABSTRACT

An inflatable watercraft having an annular flotation member, a half-floor at the forward end for occupant seating, and a floor opening at the rearward end for passage of the occupant's legs therethrough. The half-floor is located at approximately water level when the craft is afloat, so that the person's legs extend through the opening at a relatively shallow downwardly angle for efficient propulsion of the watercraft. The half-floor is preferably made up of a series of transverse inflatable tube sections mounted in edge-to-edge relationship. A quick-detach oarlock mechanism is also provided, in which a trunnion block is detachably mounted to the top of the flotation tube by means of a retractable spring-loaded axle pin.

19 Claims, 4 Drawing Sheets

INFLATABLE WATERCRAFT

This application claims benefit of Provisional Appl. No. 60/085,028 filed May 11, 1998.

FIELD OF THE INVENTION

The present invention relates generally to inflatable watercraft, and, more particularly, to a one-man inflatable craft for use in fishing and other sports activities.

BACKGROUND ART

Inflatable watercraft are commonly used for various types of water sports activities, such as fishing, hunting, touring/sightseeing, and wildlife photography, to give just a few examples.

Simple rubber rafts have been used for such purposes for many years, but their weight and poor handling qualities render them unsuitable for some uses, such as where the device must be packed a considerable distance to a fishing area, and/or must be highly-maneuverable in order to work in and about "holes" while fishing rivers or streams. For these reasons, there has been a trend in recent years towards single-person float tubes, in which the operator wears a set of waders or a wetsuit bottom and is supported from an encircling floatation tube (usually somewhat resembling a traditional "innertube") by a harness. While these devices are satisfactory for some purposes, notably fly fishing in comparatively small lakes, they lack sufficient stability and protection to permit safe operation on a river of any size, and furthermore they are simply not comfortable enough to use over an extended period of time when traversing a stretch of river or comparatively large body of water.

Some prior efforts have been made to achieve a satisfactory compromise between the conflicting requirements of compactness and stability/safety for use in rivers or for longer trips, but none of these has proven entirely satisfactory in practice. For example, U.S. Pat. Nos. 5,297,978 and 5,474,481 (both to Ramsey) show a craft which resembles an enlarged, oblong float tube, with a board or other rigid plank extending across the middle of the tube to provide a seat for the operator, whose feet protrude through a opening in the floor. While superior to traditional float tubes for some purposes, the usefulness of this device is limited by its reliance on the rigid platform (which serves a structural purpose as well as forming the seat), since this component makes the assembly difficult to fold compactly when deflated and also adds to its weight. Moreover, the craft positions the operator comparatively high out of the water, creating a high center of gravity and compromising the stability of the device, which can be a serious problem on rivers and streams. Also, the high seating position causes the operator's lower legs and feet to hang downwardly with the knees bent, which makes for very inefficient and tiring paddling with the feet, as opposed to an orientation where the legs can be kept more or less straight. Still further, the rigid board presents a wear/irritation problem where this rubs against the fabric of the inflatable tubes and the backs of the operator's legs.

Accordingly, there exists a need for an inflatable watercraft which is sufficiently light and compact when deflated that it can be conveniently packed over significant distances by a single person, yet which when inflated provides a high degree of stability and safety protection for operation on a river or other large or fast-moving body of water. Furthermore, there exists a need for such a craft in which the operator is positioned for both optimal comfort and efficient propulsion of the craft. Still further, there exits a need for such a craft which possesses a high degree of reserve buoyancy, and which can be constructed in an economical manner.

SUMMARY OF THE INVENTION

The present invention has solved the problems cited above, and is a one man inflatable water craft having a half-floor at one end on which the operator sits, and a through-opening at the other which enables the operator to propel the craft by paddling with his feet. The craft is also provided with oars which are operable from the sitting position.

The main floatation member of the craft comprises at least one floatation section which extends around the interior of the craft, and which preferably has a generally oval form so as to define forward and rearward ends. The half-floor is formed generally at the forward end, and the rearward end of the interior is open in a vertical direction to permit the operator's legs to extend downwardly into the water. Oarlocks are mounted on top of the tube sections on first and second sides of the craft, in a position which permits the operator to also row the craft.

The half-floor is preferably self-bailing, and includes a seating area which comprises at least one tube section which is partially submerged in the water when the operator is seated in the craft. The half-floor may comprise a plurality of transverse tube sections mounted in edge-to-edge relationship. The transverse tube sections may be mounted to the main floatation member so that the series of transverse tubes generally follow an inclined plane which slopes upwardly towards the rearward end of the craft. The transverse tube sections at the forward end of the half-floor preferably have a larger cross-sectional area than those at the rearward edge. In a preferred embodiment, the overall profile of the half-floor tapers from the largest and lowest tube section at the forward end to the smallest and highest tube section at the rearward end; this provides the greatest degree of additional floatation towards the forward end of the craft, beneath the occupant's torso, while the sloped bottom of the half-floor forms a superior surface for water flow when rowing the craft in the reverse direction. The half-floor may also include a generally upright back rest, and this may also comprise an inflatable tube section or a semirigid solid panel.

The main floatation member of the craft may comprise a plurality of inflatable tube sections joined in an end-toend relationship. The floatation tubes may have a larger diameter at the forward end of the craft than the diameter at the rearward end, to support the weight of the occupant, and also to provide a greater freeboard and depth at the forward end for stability and protection when rowing in a forward direction.

The present invention also provides an oarlock mechanism for use with the watercraft, which permits quick and easy attachment/detachment of the oars and also permits convenient adjustment of the distance between the pivot point and the operator seating position.

The oarlock comprises a trunnion block which is detachably mounted to a bearing block on the side of the water craft. First and second axle ends on the trunnion block engage corresponding bores in the bearing block to form a horizontal axis of rotation, and a pin near one end of the block forms the vertical pivot. At least one of the axle pins is selectively retractable from the bore in the bearing block so as to permit the trunnion block to be removed, so that the latter can be reversed end-for-end and reinstalled to shift the position of the vertical pivot in a forward or aft direction relative to the seating position.

The oarlock may also include a quick detach mechanism comprising a pivot pin which extends through a cooperating bore in the oar, and a sleeve member which fits over the oar and engages the head of the pin member. The pin member may have a groove formed under the head thereof, and the sleeve member may have a key-hole slot formed therein which engages the groove so as to selectively secure the oar to the pin. The keyhole slot may have a comparatively large opening at one end which permits the head of the oar pin to pass therethrough for installation/removal, and a comparatively narrow slot at the other end which slips into the groove under the head of the pin when the sleeve member is rotated on the shaft of the oar.

DETAILED DESCRIPTION a. Overview

Figure 1:
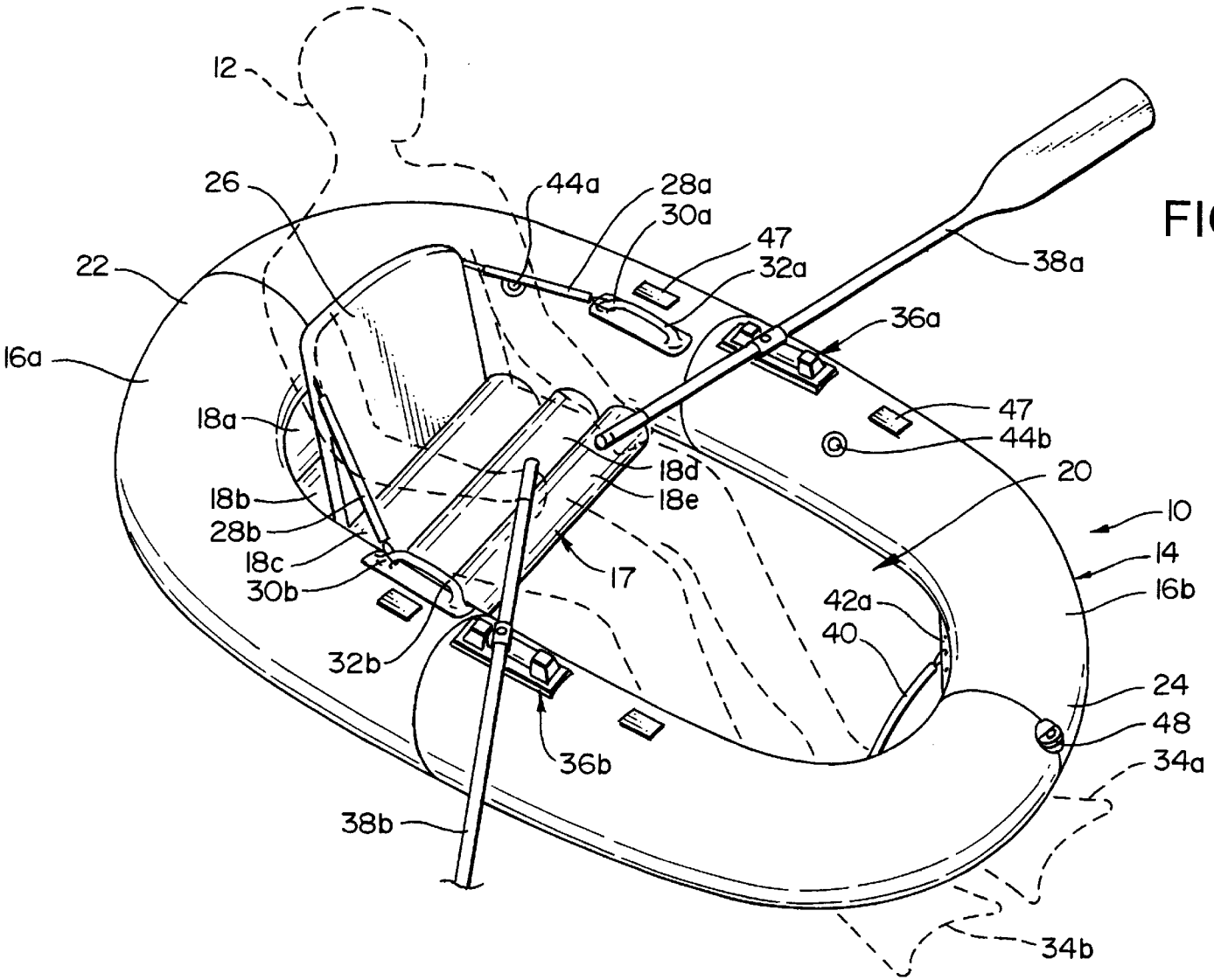
FIG. 1 is a perspective view of an inflatable wate raft in accordance with the present invention, with the dotted-line image showing an operator seated on the forward half-floor thereof.

FIG. 1 shows a highly maneuverable, one-man inflatable watercraft 10 in accordance with the present invention, with the outline of an operator 12 positioned therein. The craft includes a main floatation tube 14 which extends more or less annularly about the generally oval interior of the craft; in the embodiment which is illustrated, the main floatation tube is divided into a plurality of tube sections 16*a*, 16*b*, the first being located at the forward end 22 of the craft (behind the operator), and the latter being located at the after end 24.

The half-floor 17 is preferably made up of a plurality of transverse tube sections 18*a*, 18*b*, 18*c*, 18*d* and 18*e* which are mounted in edge-to-edge relationship and extend across the interior of the craft, between the parallel side portions of the main floatation tube. The forwardmost in the series (18*a*) has a semi-circular profile (when viewed from above) so as to fit inside the curved forward end of the main tube 14. As will be described in greater detail below, the half-floor is self-bailing, i.e., any water which enters this area is quickly drained away so as to avoid impairing the stability of the craft.

The rearwardmost transverse tube 18*e*, in turn, is preferably positioned no further back than about the midpoint of the craft (and preferably slightly forward of this), with the bottom of the craft being open in the area 20 rearward of this point.

Figure 3:
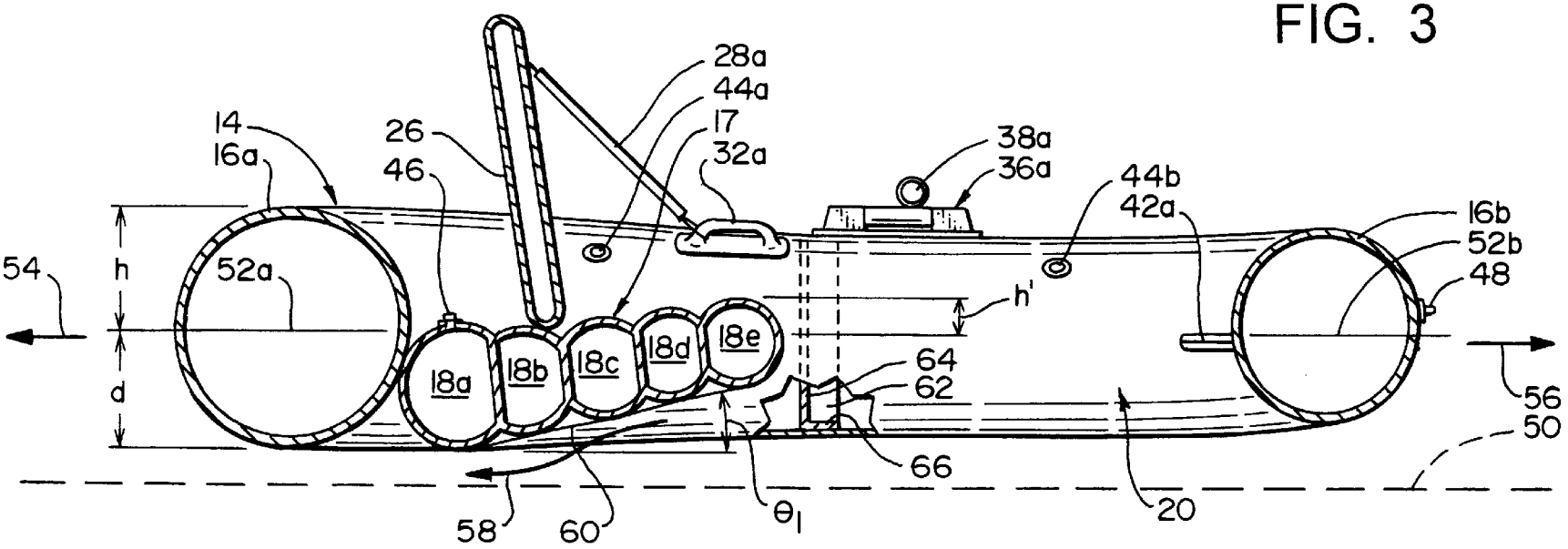
FIG. 3 is a cross-sectional view, taken along line 3—3 in FIG. 2, showing the comparative cross-sectional areas of the floatation tubes at the first and second ends of the craft, and also the cross-sectional areas of the series of inflatable tubes which form the half-floor at one end of the craft.

As can be seen in FIG. 1, a broad, generally flat tube section 26 is also mounted to the half-floor, and extends in a generally vertical direction therefrom so as to form a back support for the occupant. First and second straps 28*a*, 28*b* are attached near the upper corners of the back support and extend forwardly to attachment points 30*a*, 30*b* on the craft's lifting handles 32*a*, 32*b*; the lengths of the straps are selected to give the back support a slight lean for operator comfort, as can be seen in FIG. 3, and may be adjustable.

Accordingly, with the operator 12 positioned in the craft as indicated, his weight is positioned generally toward the forward end of the craft, with the torso slightly reclined. The operator's legs, in turn, extend downwardly into the water through opening 20 at a comparatively shallow angle, thus enabling the operator to keep the legs comparatively straight while propelling the craft using swim fins 34*a*, 34*b* or the like.

Figure 2:
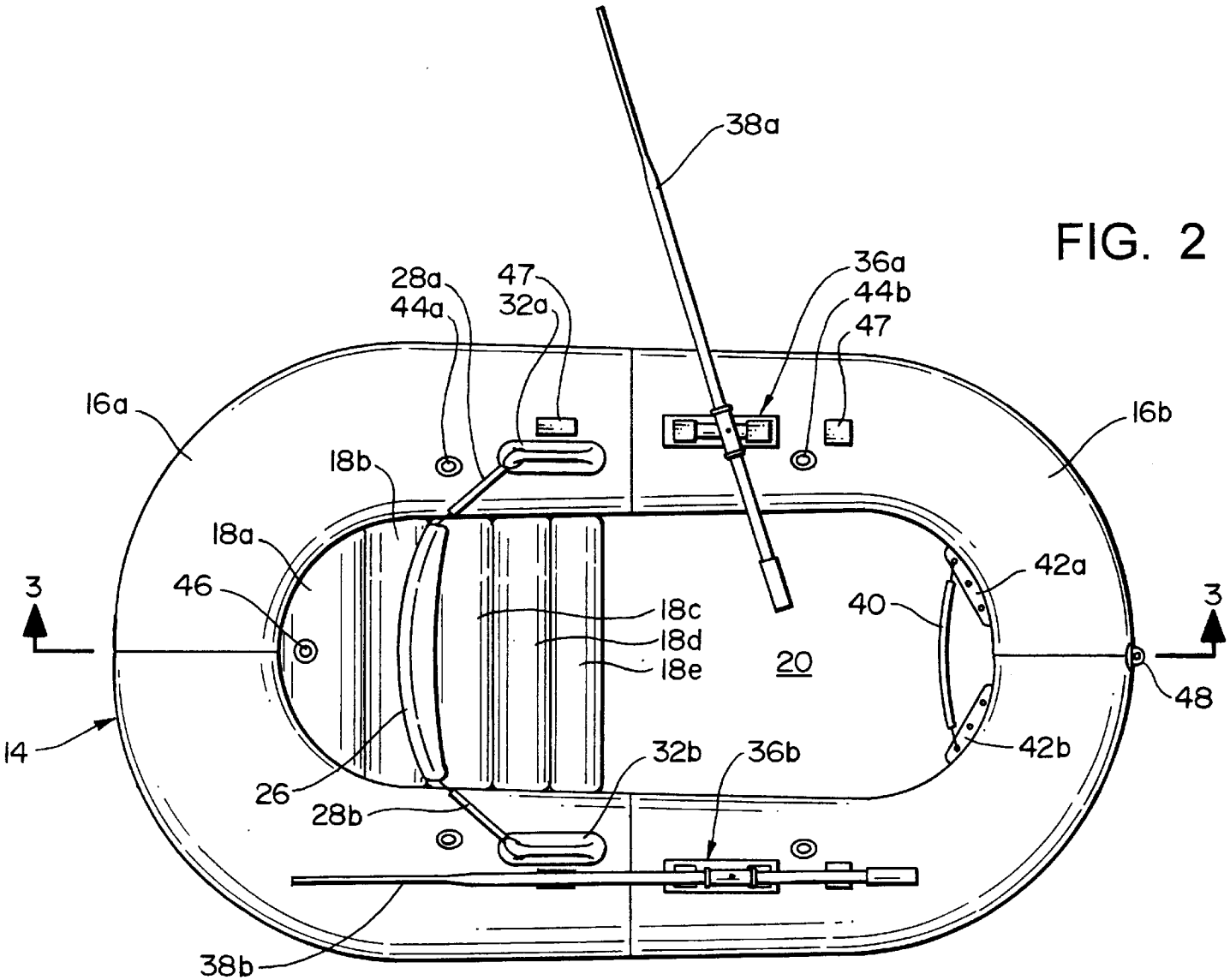
FIG. 2 is a plan view of the inflatable craft of FIG. 1, showing one oar in a stowed position and the other exte for use.

First and second oar locks 36*a*, 36*b* are mounted somewhat rearwardly of the seating area, so that the ends of oars 38*a*, 38*b* which are mounted therein are positioned for convenient use by the operator. Also, a strap member 40 is mounted across the rearward end of the interior of the craft, between attachment flanges 42*a*, 42*b*, to provide the operator with a convenient footrest while rowing or when floating through shallow water such as riffles. When not in use, the oars can be stowed in rests 47, as seen in FIG. 2. Also, a painter ring 48 is mounted to the outboard surface of the main floatation tube for attachment of a rope or line, in a position where this is within easy reach of the occupant.

b. Floatation Structure

As was noted above, the main floatation tube 14 is preferably subdivided into two or more tube sections 16*a*, 16*b*, which makes for easier inflation and also provides a degree of safety in the event of a puncture or rupture. The tube sections are provided with individual fill valves 44*a*, 44*b*. The transverse tube sections, in turn, may be provided with a single fill valve 36, with internal openings/passages (not shown) allowing air to flow through the baffles between the sections. The fabric material used to construct the floatation sections may be of any type suitable for use in the construction of inflatable watercraft, with lightness of weight and durability being desirable qualities; examples include rubberized/vinylized nylon or other cloth in various weights and grades.

FIG. 3 shows the relative sizes of the tube sections in greater detail. For reference, the figure also includes a horizontal line 50 drawn beneath the craft, and line segments 52*a*, 52*b* across the main tube sections which indicate the approximate level of immersion when the craft is loaded.

As can be seen in FIG. 3, the main floatation tube has a larger diameter/cross-sectional area at the forward end of the craft, as compared with the tube section at the rearward end. This provides a differential in floatation which accommodates the distribution of weight towards the forward end of the craft when the person is seated on the half-floor, so that the craft rides more or less level in the water. Moreover, the larger diameter of the forward tube section provides greater freeboard, or height, "h" at the front of the craft, for enhanced stability and protection from wave action (minimizing the amount of water which splashes over the edge of the craft) when rowing in the forward direction, as indicated by arrow 54 in FIG. 3. Similarly, the large diameter tube section provides a greater draft, or depth, "d" at the front of the craft, so as to form a "bumper" which provides the operator's buttocks and upper legs with added protection against striking submerged rocks or other objects when rowing in the forward direction.

As can also be seen in FIG. 3, the transverse tube sections are progressively larger and lower towards the forward end of the craft, with 18a being the largest and lowest, and 18e being the smallest and highest. The series of transverse tubes thus follow a generally inclined path which is angled upwardly toward the rearward end of the craft; because of the progression in diameters (which gives the half-floor a generally tapered or wedge-shaped contour when viewed from the edge), the bottom plane defined by the tube sections slopes upwardly at a relatively greater angle $\theta_1$ than the upper plane of the sections. Also, as can be seen in FIG. 3, the tops of all of the tube sections are positioned just slightly above the waterline 52 when the craft is fully loaded.

As a result, the gently sloped top plane of the self-bailing half-floor provides a comfortable, secure support for the occupant, while the more steeply sloped bottom plane means that progressively greater portions of the tube sections lie below the waterline towards the front of the craft. This again provides the craft with buoyancy to accommodate the greater weight loading toward the forward end, and also provides the occupant's buttocks with additional impact protection.

Furthermore, as can also be seen in FIG.3 the upward slope of the half-floor towards the rear serves to position the top of the rearwardmost transverse tube 18e at a somewhat elevated height "h" above the waterline; this provides a barrier to keep water from "sloshing" over the top of the tube section and onto the half-floor when rowing in a rearward direction, as indicated by arrow 54. Also, the sloped bottom of the half-floor creates an enhanced hydrodynamic form when rowing in the reverse direction, with the water flow being directed downwardly in a smooth path and under the front transverse tube section, as indicated by arrow 58 in FIG. 3.

A continuous bottom panel 60 is attached over the bottoms of the transverse tube sections and connects these to the main floatation tube 14 around the forward end. A plurality of drain ports 55 are formed through the bottom panel 60 around the perimeter of the self-bailing half-floor, so that what water does enter this area is quickly drained away, as indicated by arrow 57 in FIG. 3. The smooth, continuous panel 60 also helps to enhance the efficient flow of water over the bottom of the craft in this area.

The additional buoyancy provided by the inflatable, self-bailing half-floor also makes it feasible to employ a somewhat smaller main floatation section in some embodiments, thereby reducing the overall size of the craft and increasing its maneuverability. It will also be understood that in some embodiments the half-floor may be formed by a lesser or greater number of tube sections, or by longitudinally-extending tube sections or even a single tube section, preferably retaining the overall tapered (or wedge-shaped) and inclined configuration which is shown herein.

FIG. 3 also shows the butt joint or connection 62 between main floatation sections 16*a*, 16*b*. As can be seen, this includes a generally circular panel 64 which forms the divider between the two chambers, with an annular lip or rim 66 around the edge of the panel to which the outer fabric sheaths of the adjacent tube sections are attached by welding, gluing, stitching, or other suitable means. Although this connection can be formed in other ways, such as those which are known to those skilled in the relevant art, the construction shown in FIG. 3 has proven advantageous in terms of strength and durability.

Example dimensions suitable for the floatation sections and other components of the exemplary embodiment shown in FIGS. 1–3 are as follows:

Overall Length—95"
Overall Width—49"
Main Tube Diameter (forward end)—17"
Main Tube Diameter (rearward end)—13"
Half-floor Tube Diameter (forward section)—6"
Half-floor Tube Diameter (rearward section)—4"
Half-floor Area Length—32"
Half-floor Area Width—22"
Back Rest Height—16"
Back Rest Width—14"
Approx. Weight Capacity—750 lbs.

It will be understood that the above dimensions are provided as an example of those used in one embodiment of the present invention, and may be varied in other embodiments of the craft.

c. Oar Lock Mechanism

Figure 4A:
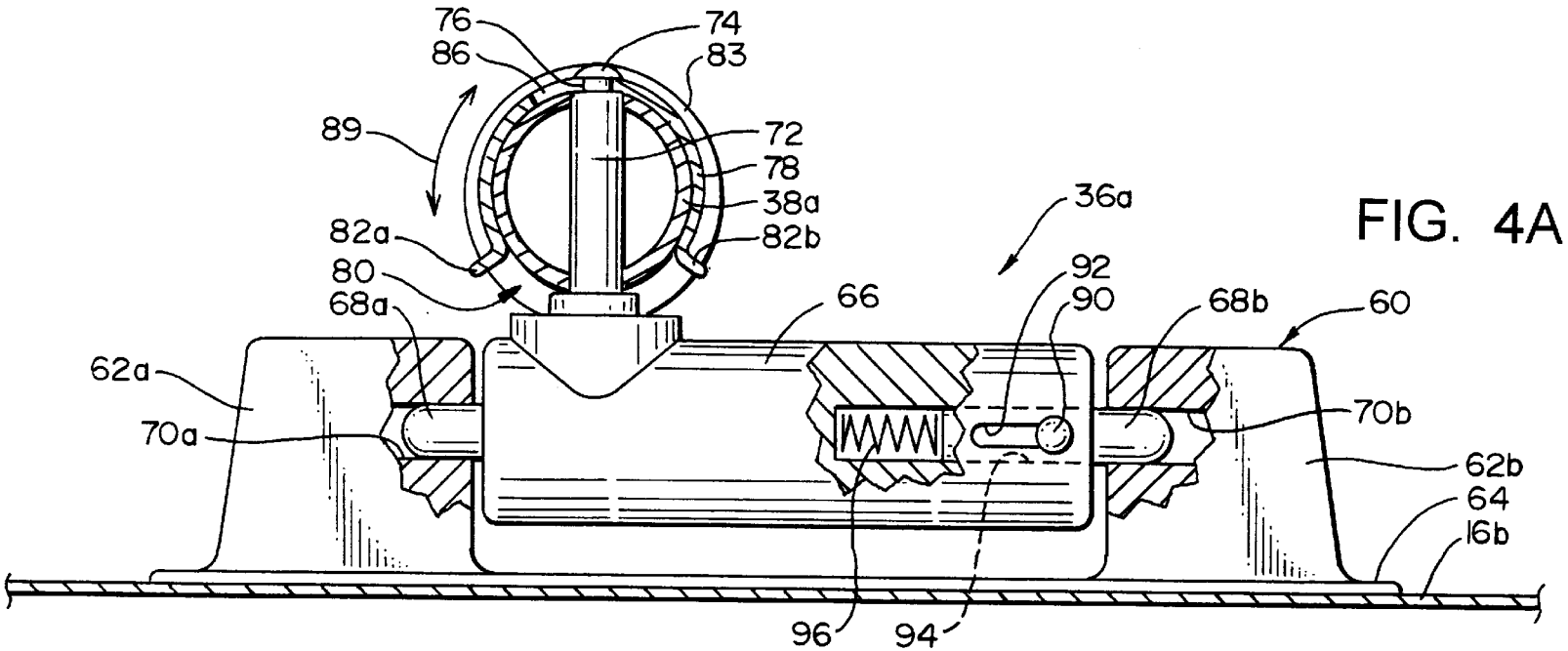
FIG. 4 is an enlarged elevational view, partially cut away, showing the construction of one of the oarlocks of the watercraft of FIGS. 1–3.
Figure 4B:
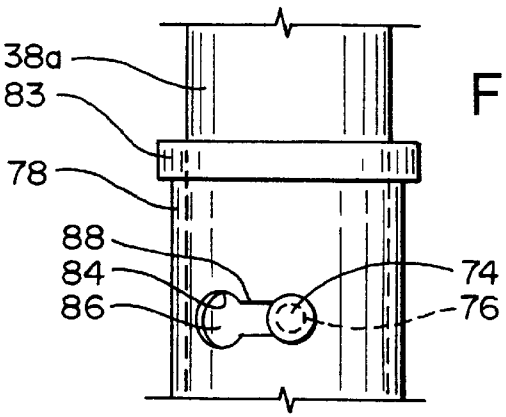

FIG. 4 shows the oar lock mechanism of the craft in greater detail. It will be understood that this design provides several advantages over traditional oar locks, but that conventional/traditional oarlocks may be employed in some embodiments of inflatable craft constructed in accordance with the present invention.

By way of background, it will be understood that an oarlock which is permanently mounted in a single position relative to the seat is not ergonomically optimum for all users; this is a particular problem in "kick" boats, where the operator has to remain in a fixed position in order to exert pressure against the boat. Furthermore, the small confines inherent in this type of craft means that the oar attachments need to have a very low profile and minimal protuberances in order to avoid snagging a fishing line. Still further, a quick-disconnect mount is desirable, in order to permit the oars to be removed/installed with a minimum of time and effort.

The oar lock shown in FIG. 4 satisfies these requirements. This includes a bearing block 60 having first and second end portions 62*a*, 62*b* which define a central receiving area, and a base flange 64 which is "welded" or otherwise attached to the top of the main flotation tube. A trunnion block 66 is rotatably mounted to the bearing block, on axle pins 68*a*, 68*b*, which extend into corresponding, coaxial bores 70*a*, 70*b* in the bearing block end portions.

The axle pins 68*a*, 68*b* provide a first (generally horizontal) axis of rotation for the oar. A pin 72 which is mounted to the top of the trunnion block 66, near one end, provides the second (generally vertical) axis of movement. The pin 72 has a low, domed head 74, with a circumferential groove 76 being formed just below the head.

A collar member 78 fits over the shaft of the oar, and has an opening 80 in its lower side which is flanked by first and second outwardly bent flanges 82*a*, 82*b*. The sleeve 78 is formed of a thin, preferably resiliently flexible material, with spring-tempered sheet metal being eminently suitable for this purpose. A keyhole opening 84 -15is formed in the upper surface of the sleeve 78; this has a clearance hole 86 at one end which is sized large enough to permit the head of pin 72 to pass therethrough, and a narrow slot 88 at the other end which is sized to slide into and engage the groove under the head of the pin. A pair of shoulders or rings 83 are mounted to the oar on either end of the sleeve 78, so as to prevent this from slipping axially along the shaft of the oar.

Accordingly, using finger flanges 82*a*, 82*b*, the operator can rotate sleeve 78 in a counterclockwise direction (as indicated by arrow 89 in FIG. 4A) to slide the narrow portion of the slot into the groove 76 under the head of pin 72, thereby securing the oar to the pin and trunnion block. Unlatching is accomplished by rotating the sleeve in the opposite direction to bring the clearance hole 86 into register with pin 72, so that the head of the pin can be withdrawn through the hole and the oar lifted off of the trunnion block.

To adjust the longitudinal position of the oar pivots (to accommodate physically larger or smaller occupants, for example), the trunnion block 66 can be removed and switched end-for-end. Since the pivot pin 72 is located at one end of the trunnion block (as opposed to being at the mid-point), this shifts the longitudinal position of the pivot by a predetermined distance, e.g., by about 4" in the embodiment which is illustrated.

A finger-actuated draw pin 90 extends laterally from one of the axle pins 68*b*, through a slot 92 in the side of the trunnion block. The axle pin 68*b* is free to slide longitudinally in a corresponding bore 94 in the trunnion block, with the range of its motion being limited by the length of slot 92. A compression spring 96 is mounted between the end of the bore and the axle pin so as to urge the latter to an extended position, in which it is received and retained in the bore of the bearing block.

Sliding the draw pin 90 towards the center of the trunnion block withdraws the axle pin from bore 70*b*, thereby allowing the trunnion block to be removed from the bearing block. The trunnion block is reversed end-for-end and placed back in the bearing block. The draw pin 90 is then released, so that the axle pin extends into bore 70*a* and locks the trunnion block to the bearing block in the new orientation.

It is to be recognized that various alterations, modifications, and/or additions may be introduced into the constructions and arrangements of parts described above without departing from the spirit or ambit of the present invention as defined by the appended claims.

What is claimed is:

1. An inflatable watercraft comprising:

an annular flotation member which substantially surrounds an interior of said watercraft, said flotation member having a generally oval form which defines first and second sides and forward and rearward ends of said watercraft;

a half-floor member which is mounted to said flotation member across a forward end of said interior so as to form a seating area which is positioned proximate a predetermined water level when said watercraft is afloat and an operator is seated therein, said half-floor member comprising at least one flotation member which is partially submerged below said predetermined water level when said watercraft is afloat and an operator is seated therein; and a floor opening formed in a rearward end of said interior generally opposite said forward end for permitting passage of said operator's legs therethrough;

so that when said watercraft is afloat and said operator is seated on said half-floor, said operator's buttocks will be positioned approximately at said water level so that said operator's legs will extend forwardly and downwardly at a shallow angle through said floor opening for efficient paddling propulsion of said watercraft.

2. The watercraft of claim 1, further comprising:

a pair of oars mounted to said flotation member for manipulation by an operator when seated on said half-floor.

3. The watercraft of claim 1, wherein said half-floor member comprises:

a plurality of inflatable tube sections mounted transversely between first and second sides of said flotation member in edge-to-edge relationship.

4. The watercraft of claim 3, wherein said plurality of inflatable tube sections mounted in edge-to-edge relationship comprises:

a series of inflatable tube sections mounted to said sides of said flotation member so as to generally follow an inclined plane which slopes upwardly from said forward end towards said rearward end of said watercraft.

5. The watercraft of claim 4, wherein said series of tube sections comprises:

a series of transverse tube sections which are progressively larger in cross-sectional area from a rearward edge of said half-floor member towards a forward end of said half-floor member.

6. The watercraft of claim 5, wherein said half-floor member comprises:

a half-floor member having a cross-sectional contour which tapers from a largest and lowest tube section at said forward end of said floor member to a smallest and highest tube section at said rearward edge of said half-floor member;

so that said half-floor member provides maximum flotation under a torso of an operator seated on said half-floor member, and so that a bottom surface of said half-floor member slopes upwardly towards said rearward end of said watercraft for hydrodynamically efficient flow of water thereunder.

7. The watercraft of claim 6, wherein said half-floor further comprises:

a generally upright backrest which extends upwardly at said forward end of said half-floor member.

8. The watercraft of claim 7, wherein said backrest member comprises:

at least one inflatable tube section.

9. The watercraft of claim 1, wherein said generally oval flotation member comprises:

a rearward end portion having a relatively smaller cross-sectional area; and a forward end portion having a relatively greater cross-sectional area for increased freeboard and stability at said forward end of said watercraft.

10. The watercraft of claim 8, wherein said generally oval flotation member further comprises:

a plurality of inflatable tube sections joined in end-to-end relationship.

11. An inflatable watercraft comprising:

an annular flotation member which substantially surrounds an interior of said watercraft, said flotation member having a generally oval form which defines first and second sides and forward and rearward ends of said watercraft, said flotation member comprising:

a rearward end portion having a relatively smaller cross-sectional area; and a forward end portion having a relatively greater cross-sectional area for increased freeboard and stability at said forward end of said watercraft;

a half-floor mounted to said flotation member across said interior at said forward end of said watercraft so as to form a seating area which is positioned proximate a predetermined water level when said watercraft is afloat and an operator is seated therein, said half-floor comprising a series of inflatable tube sections mounted transversely between first and second sides of said oval flotation member in edge-to-edge relationship, so as to generally follow an inclined plane which slopes upwardly from said forward end towards said rearward end of said watercraft, said transverse tube sections being progressively larger in cross-sectional area from a rearward edge of said half-floor towards a forward end of said half-floor;

a floor opening formed in said interior at said rearward end of said watercraft generally opposite said seating area for permitting passage of said operator's legs therethrough; and first and second oarlock mechanisms mounted to said flotation member along said sides of said watercraft for attachment of oars thereto;

so that when said watercraft is afloat and said operator is seated on said half-floor, said operator will be able to manipulate oars which are attached to said oarlock mechanisms, and said operator's buttocks will be positioned approximately at said water level so that said operator's legs will extend forwardly and downwardly at a shallow angle through said floor opening for efficient paddling propulsion of said watercraft.

12. An oarlock mechanism for a watercraft, said oarlock mechanism comprising:

a bearing member which is mountable to said watercraft;

a trunnion member which is mountable to an oar;

means for detachably mounting said trunnion member to said bearing member for pivoting movement about a generally horizontal axis of rotation; and means for mounting an oar to said trunnion member for pivoting movement about a generally vertical axis of rotation;

said means for detachably mounting said trunnion member to said bearing member comprising:

a receiving portion of said bearing member having first and second opposing bores aligned along said generally horizontal axis; and first and second axle pins on said trunnion member for being received in pivoting engagement with said opposing bores when said trunnion member is installed in said receiving portion of said bearing member;

at least one of said axle pins being selectively retractable so as to permit said trunnion member to be selectively installed in and removed from said receiving portion of said bearing member; and said means for mounting an oar to said trunnion member comprising:

a pivot pin extending from said trunnion member along said generally vertical axis;

a mounting portion of said oar having a bore formed therein for receiving said pivot pin in pivoting engagement therewith; and means for detachably securing said oar to said trunnion member, said means for detachably securing said oar to said trunnion member comprising:

a head portion of said pivot pin which protrudes from an upper side of said oar when said pin member is received in said bore in said oar, said protruding head portion of said pivot pin having an undercut groove formed therein; and a sleeve member mounted for sliding movement on said oar, said sleeve member having a slot portion for selectively engaging said undercut groove on said head portion of said pivot pin so as to prevent said pivot pin from being withdrawn from said oar.

13. An inflatable watercraft comprising:

an annular flotation member which substantially surrounds an interior of said watercraft;

a half-floor mounted to said flotation member across a first end of said interior so as to form a seating area which is positioned proximate a predetermined water level when said watercraft is afloat and an operator is seated therein;

a floor opening formed in a second end of said interiod generally opposite said first end for permitting passage of said operator's legs therethrough, so that when said watercraft is afloat and said operator is seated on said half-floor, said operator's buttocks will be positioned approximately at said water level so that said operator's legs will extend forwardly and downwardly at a shallow angle through said floor opening for efficient paddling propulsion of said watercraft; and first and second oarlock mechanisms mounted to said flotation member for attachment of oars thereto, each said oarlock mechanism comprising:

a bearing member which is mounted to said flotation member;

a trunnion member which is mountable to an oar; and means for detachably mounting said trunnion member to said bearing member for pivoting movement about a generally horizontal axis of rotation.

14. The watercraft of claim 12, further comprising:

means for mounting an oar to said trunnion member for pivoting movement about a generally vertical axis of rotation.

15. The watercraft of claim 13, wherein said means for detachably mounting said trunnion member to said bearing member comprises:

a receiving portion of said bearing member having first and second opposing bores aligned along said generally horizontal axis; and first and second axle pins on said trunnion member for being received in pivoting engagement with said opposing bores when said trunnion member is installed in said receiving portion of said bearing member;

at least one of said axle pins being selectively retractable so as to permit said trunnion member to be selectively installed in and removed from said receiving portion of said block member.

16. The watercraft of claim 14, wherein said means for mounting an oar to said trunnion member comprises:

a pivot pin extending from said trunnion member along said generally vertical axis; and a mounting portion of said oar having a bore formed therein for receiving said pivot pin in pivoting engagement therewith.

17. The watercraft of claim 15, wherein said pivot pin extends from said trunnion member proximate one end thereof, so that a longitudinal position of said pin member relative to said horizontal axis is selectively adjustable by reversing said trunnion member end-for-end within said receiving portion of said bearing member.

18. The watercraft of claim 15, further comprising means for detachably mounting an oar to said trunnion member.

19. The watercraft of claim 17, wherein said means for detachably mounting an oar to said trunnion member comprises:

a head portion of said pivot pin which protrudes from an upper side of said oar when said pin member is received in said bore in said oar, said protruding head portion of said pivot pin having an undercut groove formed therein; and a sleeve member mounted for sliding movement on said oar, said sleeve member having a slot portion for selectively engaging said undercut groove on said head portion of said pivot pin so as to prevent pivot pin from being withdrawn from said oar.

* * * * *